US006493941B1

(12) United States Patent
Wong

(10) Patent No.: US 6,493,941 B1
(45) Date of Patent: Dec. 17, 2002

(54) MOTOR-DRIVEN RAZOR

(75) Inventor: Ying Man John Wong, Shatin (HK)

(73) Assignee: Good Nature Company Ltd., Shatin (HK)

( * ) Notice: Subject to any disclaimer, the term of this patent is extended or adjusted under 35 U.S.C. 154(b) by 0 days.

(21) Appl. No.: 09/899,678

(22) Filed: Jul. 5, 2001

(51) Int. Cl.[7] ..... B26B 19/16
(52) U.S. Cl. ..... 30/43.6
(58) Field of Search ..... 30/43.6, 346.51, 30/43.5, 206, 29.5

(56) References Cited

U.S. PATENT DOCUMENTS

| | | | | |
|---|---|---|---|---|
| 2,307,303 A | * | 1/1943 | Richardson et al. | 30/43.6 |
| 2,577,383 A | * | 12/1951 | Thirring | 30/43.6 |
| 4,521,962 A | | 6/1985 | Van Natta | 30/34.1 |

FOREIGN PATENT DOCUMENTS

| | | |
|---|---|---|
| GB | 1 406 830 | 11/1972 |
| GB | 2 318 722 A | 5/1998 |

* cited by examiner

*Primary Examiner*—Douglas D. Watts
(74) *Attorney, Agent, or Firm*—Alix, Yale & Ristas, LLP

(57) ABSTRACT

A foil-type electric razor includes a coaxial motor and cutter. The coaxial relationship between the motor and the cutter permits a simplified suspension and drive assembly. The driven end of the cutter is supported and driven by a flexible drive shaft connected to the motor shaft. The opposite end of the cutter is supported for rotation by a flexible support shaft extending from the cutter to a bearing mounted accessory drive stud. Both the drive shaft and support shaft are constructed from coil springs. The coil spring shafts effectively combine the suspension, drive and support functions that in the prior art required multiple components. An optional nose hair trimmer may be driven by the flexible support shaft.

13 Claims, 4 Drawing Sheets

MOTOR-DRIVEN RAZOR

BACKGROUND OF THE INVENTION

1. Field of the Invention

This invention relates to electric razors, and more particularly to electric razors of the type incorporating a perforated stationary cutting foil and an internal, motor-driven blade.

2. Description of the Related Art

Stationary foil/rotating blade shavers are well known in the art. Typically, this type of electric razor has a rectangular bar-shaped body with the foil-cutter arranged along one edge of the body. U.S. Pat. Nos. 4,894,912 and 5,014,428 are examples of this common configuration. A barrel shaped cutter includes blades arranged on its outside surface and rotates against the inside surface of a perforated arc shaped foil. Hairs passing through the perforations are sheared by passing blades. The position and orientation of the cutter relative to the bar-shaped body complicate application of rotational motion to the cutter. Typically, belts or gear drives are used to transmit rotational energy provided by an electric motor to one or the other end of the cutter. The delicacy and complexity of these drive arrangement complicates assembly and reduces the reliability of the typical prior art electric razor.

In addition, the typical prior art configuration makes it difficult to both transmit rotational energy to the blade and maintain an appropriate cutting interface between the inside surface of the foil and the blade. To achieve a clean shave, the contact pressure between the blade and the inside surface of the foil, i.e., at the cutting interface, must be consistent. The cutting interface is exposed to forces produced by the drive mechanism as well as force exerted on the foil by the user. These forces, which may be intermittent and variable, have a tendency to alter the relationship between the foil and the blade. The typical prior art electric razor incorporates complex mechanisms to regulate the "feel" of the foil to the user's face, while maintaining a proper cutting interface between the blade and the foil. Such mechanisms are difficult to assemble, expensive to manufacture and prone to malfunction.

If the cutting interface, i.e., the relationship between the inside surface of the foil and the rotating blade, is not sufficiently close, hairs protruding through the foil will be pulled instead of caught. Conversely, if the blade rubs on the inside surface of the foil with excessive force, heat will be generated and blades will wear prematurely.

SUMMARY OF THE INVENTION

A preferred embodiment of a motor-driven razor in accordance with the present invention re-aligns the motor and cutter on a common axis. This arrangement makes a simplified drive and suspension system possible. The cutter is resiliently mounted for rotation between a drive motor shaft and an accessory drive stud by flexible shafts. The flexible shafts are coil springs that permit the cutter to move off-axis in response to force transverse to the axis of rotation and spring back when the force is removed. The resiliently mounted cutter rotates against the inside surface of a resiliently mounted cutting foil. The cutting interface between the cutting foil inside surface and blades mounted to the cutter is maintained while the cutter and cutting foil are permitted to move in response to forces produced by normal use of the motor driven razor. The motor-driven razor may be equipped with an optional nose hair trimmer driven by the accessory drive stud.

The overall construction of a motor-driven razor in accordance with the present invention is dramatically simplified in comparison with the prior art. This simplified construction also reduces manufacturing costs. The realignment of components results in a more compact appliance that can be conveniently placed in a shirt pocket, for example. The resulting motor-driven razor is inexpensive, yet effective.

It is an object of the present invention to provide a new and improved motor-driven razor that overcomes the deficiencies of the prior art.

Another object of the present invention is to provide a new and improved motor-driven razor of compact and efficient design.

A further object of the present invention is to provide a new and improved motor-driven razor of reduced complexity and increased reliability.

These and other objects, features and advantages of the invention will become readily apparent to those skilled in the art upon reading the description of the preferred embodiments in conjunction with the accompanying drawings.

DETAILED DESCRIPTION OF THE PREFERRED EMBODIMENT

Figure 1:
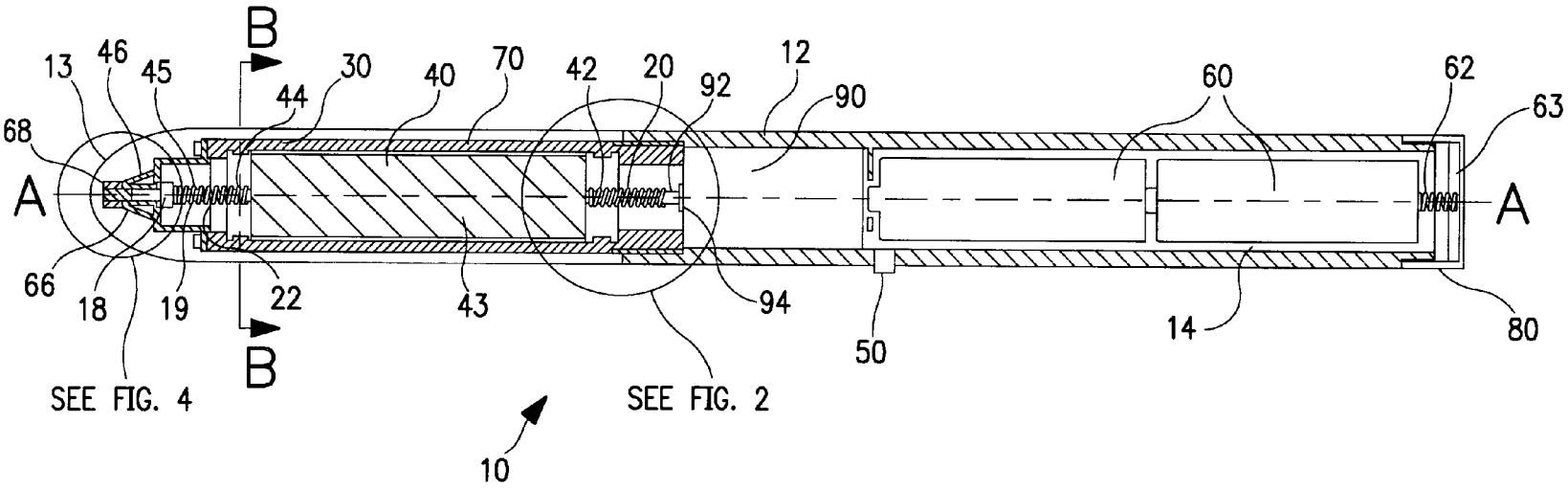
FIG. 1 is a longitudinal sectional view through a motor-driven razor in accordance with the present invention.

With reference to the drawings in which like parts are designated by like reference numerals throughout the several figures, a preferred embodiment of a motor-driven razor in accordance with the present invention is generally designated by the numeral 10. The motor-driven razor 10 is a personal grooming device for shaving the face or other body parts.

Figure 6:
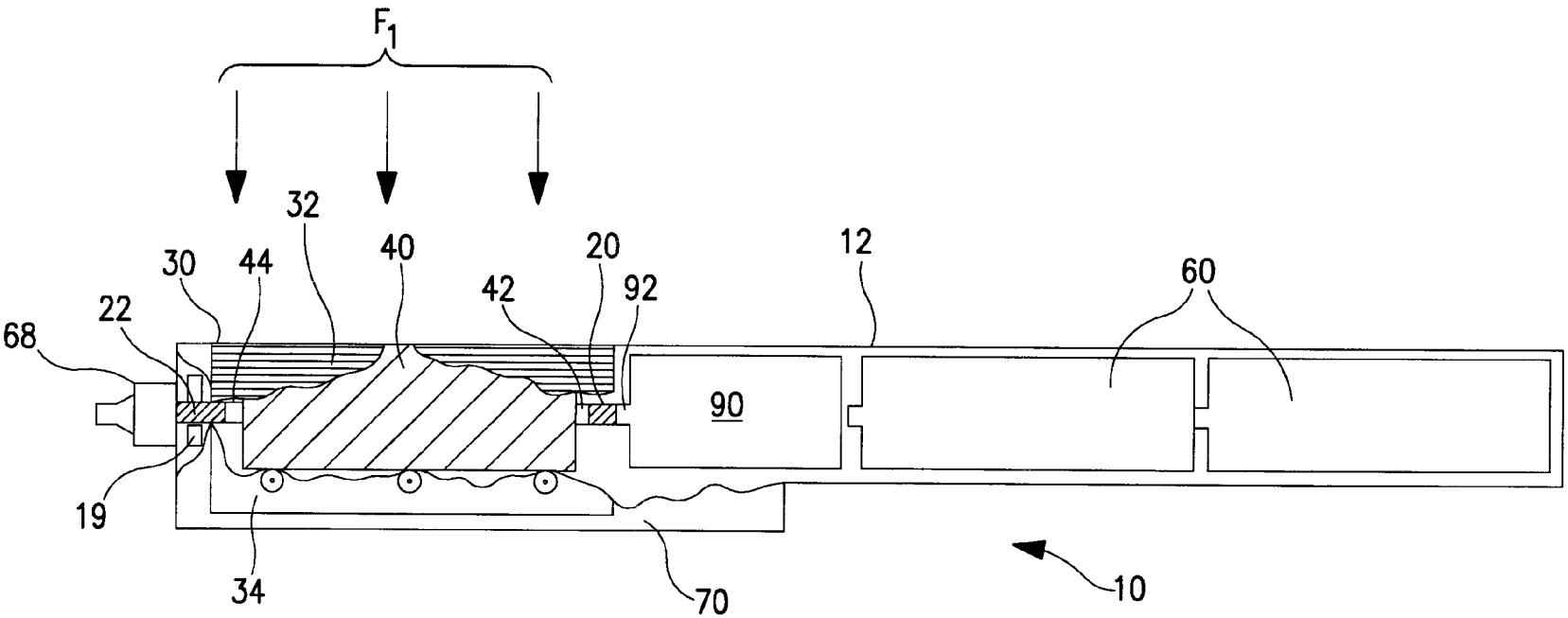
FIG. 6 is a side view, partly broken away, of the motor-driven razor of FIG. 1.

As is best seen in FIGS. 1 and 6, a preferred embodiment of the motor-driven razor 10 is long and slender, resembling a large tooth brush in configuration. A longitudinally extending case 12 encloses a compartment 14 configured to receive batteries 60. An end cap 80 equipped with conductive plate 63 and spring 62 retains the batteries in the enclosure 14 in electrical contact with each other and the conductive plate 63. A motor 90 is also retained in the case 12. The motor 90 receives electricity from the batteries 60 when switch 50 is activated. A sub-frame 70 mounts to the case 12 opposite the end cap 80. The sub-frame 70 extends longitudinally from the case 12 and provides support for a cutter 40. The cutter 40 is cylindrical in shape, and includes a plurality of spiral blades 43 surrounding the cutter. Support studs 42, 44 extend from each end of the cutter along the axis of rotation A. The motor includes a bearing 94 supporting a shaft 92. Rotational energy is transmitted from the motor shaft to the cutter 40 via a flexible drive shaft 20.

The cutter 40 and motor 90 may share a common axis of rotation A. This generally parallel and axially spaced relationship simplifies the drive mechanism significantly by permitting rotational energy to be transmitted from the motor 90 to the cutter 40 by one simple component, e.g., the flexible drive shaft 20 comprising a coil spring. Other flexible drive means, such as a universal coupling are of course possible. The opposite end of the cutter 40 is supported by a coil spring support shaft 22 extending from the support stud 44 on the cutter 40 to a shaft 45 on an accessory drive stud 18 mounted in a.bearing 19. The cutter 40 is thus suspended for rotation between the motor bearing 94 and the bearing-mounted accessory drive stud 18. The flexible nature of the drive shaft 20 and support shaft 22 permit the cutter 40 to be resiliently displaced from its axis of rotation A in response to force $F_1$ transverse to the axis.

Figure 2:
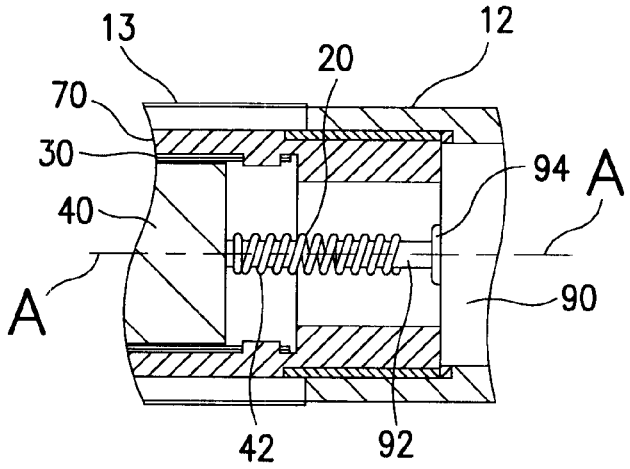
FIG. 2 is an enlarged sectional view of the motor/blade interface of the motor-driven razor of FIG. 1.

FIG. 2 is an enlarged view of the drive connection between the motor 90 and cutter 40. A length of coil spring drive shaft 20 extending between the motor shaft 92 and support stud 42 supports the cutter 40. In accordance with the invention, the coil spring drive shaft 20 serves the dual functions of drive mechanism and resilient suspension for the cutter 40. The interface between the opposite end of the cutter and the accessory drive stud 18 behaves in a similar manner. It should be noted that the flexible drive and support shafts 20, 22, respectively, combine the resilient support and drive functions in a single component. In prior art assemblies, these functions were performed by multiple cooperating precision components.

Figure 3:
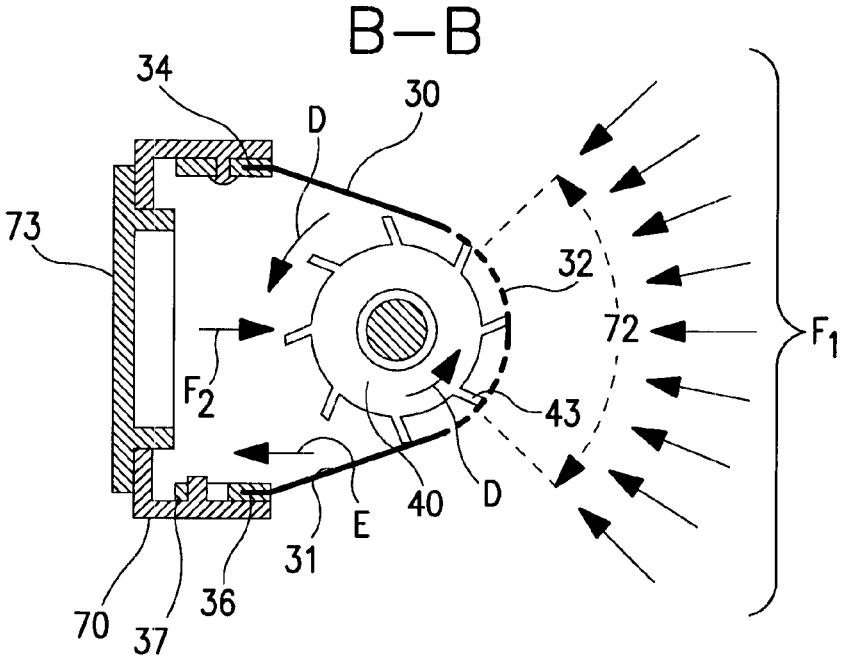
FIG. 3 is an enlarged sectional view through the motor-driven razor of FIG. 1, taken along line B—B thereof.
Figure 4:
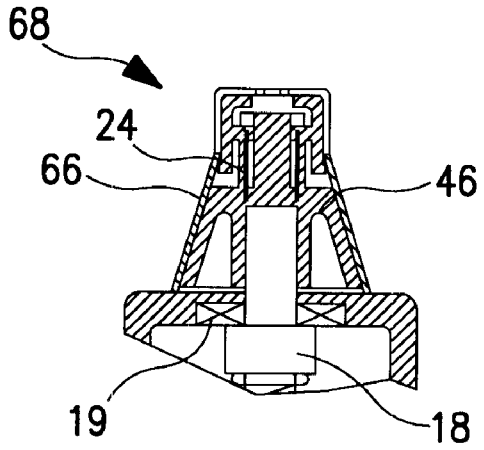
FIG. 4 is an enlarged sectional view of the nose hair trimmer portion of the motor-driven razor of FIG. 1 and oriented at a 90° angle thereto.
Figure 5:
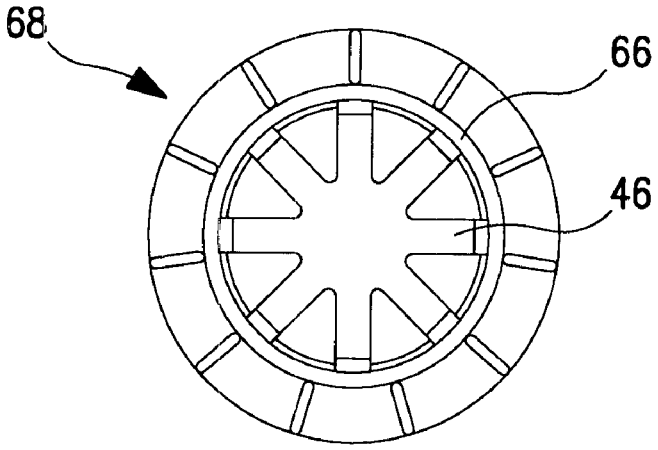
FIG. 5 is a left end view of the motor-driven razor of FIG. 1.

FIG. 3 is a sectional view through the motor-driven razor illustrating the relationship between blades 43 and the inside surface 31 of the cutting foil 30. Maintenance of an accurate blade/foil or cutting interface is crucial to the efficient and effective operation of the motor-driven razor. The cutting foil 30 is typically constructed of a thin, flexible and durable material such as stainless steel. The cutting foil 30 is provided with a plurality of openings 32 through which hairs pass to enter the cutting interface.

To maintain the cutting interface, the cutting foil 30 must be able to move in response to force $F_1$ transverse to the axis of rotation A. FIG. 3 best illustrates the manner in which the cutting foil 30 is resiliently attached to the sub-frame 70 to permit relative movement between the cutting foil 30 and the sub-frame 70. One edge 34 of the cutting foil 30 is securely affixed to the sub-frame 70. The opposite edge 36 of the cutting foil 30 is slidably mounted with respect to the sub-frame 70. Edge clip 37 limits movement of the cutting foil 30 away from the sub-frame 70, while permitting some deflection toward the sub-frame 70 in response to force $F_1$.

When force $F_1$ is zero, the resiliently suspended cutter 40 exerts some outward force $F_2$ against the cutting foil 30. Outward movement of the cutting foil 30 in response to this outward force $F_2$ is limited by the engagement of edge clip 37 with sub-frame 70. A close sliding relationship or "cutting interface" is thus produced between the blades 43 and the inside surface 31 of the cutting foil. It should be noted that the cutter 40 rotates in direction D while the cutting foil 30 is resiliently displaceable in direction E, or generally opposite the direction of rotation D. This opposed relationship puts an outward tension on the cutting foil 30 in addition to the outward force $F_2$. Because both the cutting foil 30 and the cutter 40 are mounted to permit resilient displacement in response to transverse forces 100, an accurate cutting interface can be maintained while the cutting foil 30 responds to the transverse forces 100. The arcuate extent 72 of the cutting interface (contact between blades 43 and cutting foil inside surface 31) subtends an angle of approximately 45.

FIG. 6 illustrates a cut away side view of the motor-driven razor 10. The sub-frame 70 projects rearwardly from the case 12. The necessity for this rearward projection of the sub-frame 70 becomes clear when the internal configuration of the motor-driven razor in the cutter/foil region is examined in conjunction with FIG. 3. The rearward projecting portions of the sub-frame 70 provide locations for the fixed and resilient mounting of the edges 34, 36 of the cutting foil 30.

The illustrated preferred embodiment includes a nose hair trimmer 68 axially extending from the sub-frame 70. The flexible support shaft 22 applies rotational force to the bearing-mounted accessory drive stud 18 that drives the rotating portion 46 of the nose hair trimmer. A shear relationship between the rotating portion 46 and the stationary portion 66 of the nose hair trimmer 68 provides a second cutting interface.

For cleaning purposes, a cap 73 (FIG. 3) is provided on the sub-frame 70. The cap 73 allows access to the area behind the cutting foil 30 to remove cut hair. A cover 13 (FIG. 1) is provided to protect the mechanism of the motor-driven razor when it is not being used.

As will be apparent to one of skill in the art, the inventive rearrangement of components in the motor-driven razor results in a remarkable efficiency of both space and components. A motor-driven razor in accordance with the present invention is far more compact than prior art type electric razors. The number of parts required to assemble the motor-driven razor is dramatically reduced in comparison to typical conventional razors. The result is an inexpensive yet practical motor-driven razor 10.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A motor driven razor comprising:

a generally cylindrical case including a sub-frame extending from a first end, said sub-frame supporting a bearing;

a motor having a first axis and a rotatable motor shaft extending from one end of said motor along said first axis;

a rotary cutter having an axis of rotation, a plurality of angularly spaced blades and rotation support means on said axis of rotation for supporting said cutter, said rotation support means located at a driven end of said cutter proximal to said motor and a support end of said cutter axially opposed to said driven end;

a flexible support shaft extending between the rotation support means at said support end and said bearing, said flexible support shaft permitting resilient off axis movement of the support end of said cutter relative to said sub-frame;

a flexible cutting foil having inner and outer surfaces; and a coupling joining said motor shaft and said rotation support means;

wherein said motor is mounted within said case and said cylindrical cutter is mounted in said sub-frame so that said cutter axis of rotation is generally parallel with said first axis, said coupling axially intermediate said motor and said cutter and said cutting foil is mounted to said sub-frame to extend over said blades, said cutter rotating against said inner surface, sliding contact between said blades and said inner surface defining a cutting interface.

2. The motor driven razor of claim 1, wherein said motor first axis and said cutter axis of rotation are coaxial.

3. The motor driven razor of claim 1, wherein said coupling is flexible.

4. The motor driven razor of claim 1, wherein said coupling comprises a flexible drive shaft extending from said motor shaft to the rotation support means at a driven end of said cutter, said flexible drive shaft permitting relative off-axis movement of said cutter relative to said motor.

5. The motor driven razor of claim 4, wherein said flexible drive shaft and flexible support shaft permit resilient displacement of said cutter in response to force exerted on said cutter transverse to said axis of rotation.

6. The motor driven razor of claim 5, wherein said motor includes at least one shaft bearing for support of said motor shaft and said cutter is supported for rotation between said second bearing and said at least one shaft bearing.

7. The motor driven razor of claim 6, wherein said cutting foil includes first and second edges, said first edge fixed to said sub-frame and said second edge slidably mounted relative to said sub-frame permitting resilient deflection of said cutting foil in response to force exerted on said cutting foil transverse to said cutter axis of rotation, said resiliently mounted cutter moving in concert with said foil to maintain said cutting interface.

8. The motor driven razor of claim 1, wherein said cutting interface subtends an angle of at least 45° and extends along said cutter parallel to said cutter axis of rotation.

9. The motor driven razor of claim 1, wherein said case includes a storage compartment for storage of batteries, said batteries operatively connected to provide power to said motor for rotating said cutter.

10. The motor driven razor of claim 4, wherein said flexible drive shaft comprises a coil spring shaft.

11. The motor driven razor of claim 5, wherein said flexible support shaft comprises a coil spring shaft.

12. The motor driven razor of claim 5, wherein said flexible support shaft transmits rotational force through said second bearing and provides said rotational force to a trimmer assembly mounted to an axial end portion of said sub-frame, said trimmer assembly including a trimmer blade having an axis of rotation coaxial with the cutter axis of rotation.

13. The motor driven razor of claim 7, wherein said cutter rotates in a direction D opposed to a direction E of resilient displacement of said cutting foil.

* * * * *